United States Patent [19]

Derbyshire et al.

[11] Patent Number: 4,604,189

[45] **Date of Patent: * Aug. 5, 1986**

[54] HYDROCRACKING OF HEAVY FEEDS WITH DISPERSED DUAL FUNCTION CATALYST

[75] Inventors: Francis J. Derbyshire, State College, Pa.; Philip Varghese, Voorhees, N.J.

[73] Assignee: Mobil Oil Corporation, New York, N.Y.

[ * ] Notice: The portion of the term of this patent subsequent to Apr. 8, 2003 has been disclaimed.

[21] Appl. No.: 685,589

[22] Filed: Dec. 24, 1984

[51] Int. Cl.[4] ..... C10G 47/20

[52] U.S. Cl. ..... 208/111; 208/112; 208/216 R; 208/251 H

[58] Field of Search ..... 208/111, 120, 108, 112, 208/216 R, 251 H, 254 H

[56] References Cited

U.S. PATENT DOCUMENTS

| | | | |
|---|---|---|---|
| 1,876,270 | 9/1932 | Zorn | 208/108 |
| 2,091,831 | 8/1937 | Pongratz et al. | 208/108 |
| 3,131,142 | 4/1964 | Mills, Jr. | 208/108 |
| 3,161,585 | 12/1964 | Gleim et al. | 208/264 |
| 3,235,508 | 2/1966 | Mills | 208/110 X |
| 3,331,769 | 7/1967 | Gatsis | 208/210 |
| 3,354,078 | 11/1967 | Miale et al. | 208/120 |
| 3,657,111 | 4/1972 | Gleim | 208/108 |
| 3,676,331 | 7/1972 | Pitchford | 208/112 |
| 4,142,962 | 3/1979 | Yates et al. | 208/109 |
| 4,192,735 | 3/1980 | Aldridge | 208/112 |
| 4,226,742 | 10/1980 | Bearden, Jr. et al. | 208/55 X |
| 4,313,818 | 2/1982 | Aldridge et al. | 208/108 |
| 4,389,301 | 6/1983 | Dahlberg et al. | 208/59 |
| 4,411,770 | 10/1983 | Chen et al. | 208/111 |
| 4,435,277 | 3/1984 | Dinh et al. | 208/108 |
| 4,468,316 | 8/1984 | Swanson | 208/59 |
| 4,551,230 | 11/1985 | Kukes et al. | 208/89 |
| 4,564,441 | 1/1986 | Kukes et al. | 208/108 |
| 4,581,127 | 4/1986 | Varghese | 208/143 |

*Primary Examiner*—Brian E. Hearn
*Assistant Examiner*—O. Chaudhuri
*Attorney, Agent, or Firm*—Alexander J. McKillop; Michael G. Gilman; Malcolm D. Keen

[57] ABSTRACT

Catalytic hydroconversion of a relatively heavy hydrocarbon residual fraction is effected by adding a thermally decomposable metal compound to the oil, along with an acidic catalyst solid to the oil, and passing the mixture to a hydroconversion zone containing hydrogen at an elevated temperature. Preferred metals are cobalt and molybdenum. Preferred solids are large pore zeolites, silica/alumina, clays and surface activated metal oxides.

20 Claims, No Drawings

HYDROCRACKING OF HEAVY FEEDS WITH DISPERSED DUAL FUNCTION CATALYST

BACKGROUND OF THE INVENTION

1. Field of the Invention

This invention relates to a process for hydrocracking of heavy oil feeds using a dispersed dual function catalyst which is prepared in situ.

2. Description of the Prior Art

Hydrorefining processes utilizing dispersed calalysts in admixture with a hydrocarbonaceous oil are well known. The term "hydrorefining" is intended herein to designate a catalytic treatment, in the presence of hydrogen, of a hydrocarbonaceous oil to upgrade the oil by eliminating or reducing the concentration of contaminants in the oil such as sulfur compounds, nitrogenous compounds, metal contaminants and/or to convert at least a portion of the heavy constituents of the oil such as asphaltenes or coke precursors to lower boiling hydrocarbon products, and to reduce the Conradson carbon residue of the oil.

U.S. Pat. No. 3,161,585 discloses a hydrorefining process in which a petroleum oil chargestock containing a colloidally dispersed catalyst selected from the group consisting of a metal of Groups VB and VIB, an oxide of said metal and a sulfide of said metal is reacted with hydrogen at hydrorefining conditions. This patent teaches that a concentration of the dispersed catalyst, calculated as the elemental metal, in the oil chargestock is from about 0.1 weight percent to about 10 weight percent of the initial chargestock.

U.S. Pat. No. 3,331,769 discloses a hydrorefining process in which a metal component (Group VB, Group VIB, iron group metal) colloidally dispersed in a hydrocarbonaceous oil is reacted in contact with a fixed bed of a conventional supported hydrodesulfurization calalyst in the hydrorefining zone. The concentration of the dispersed metal component which is used in the hydrorefining stage in combination with the supported catalyst ranges from 250 to 2500 weight parts per million (wppm).

U.S. Pat. No. 3,657,111 discloses a process for hydrorefining an asphaltene-containing hydrocarbon chargestock which comprises dissolving in the chargestock a hydrocarbon-soluble oxovanadata salt and forming a colloidally dispersed catalytic vanadium sulfide in situ within the chargestock by reacting the resulting solution, at hydrorefining conditions, with hydrogen and hydrogen sulfide.

U.S. Pat. No. 3,131,142 discloses a slurry hydrocracking process in which an oil soluble dispersible compound of Groups IV to VIII is added to a heavy oil feed. The catalyst is used in amounts ranging from 0.1 to 1 weight percent, calculated as the metal, based on the oil feed.

U.S. Pat. No. 1,876,270 discloses the use of oil soluble organometallic compounds in thermal cracking or in destructive hydrogenation (hydrocracking) of hydrocarbons to lower boiling products.

U.S. Pat. No. 2,091,831 discloses cracking or destructive hydrogenation carried out in the presence of oil soluble salts of acid organic compounds selected from the group consisting of carboxylic acids and phenols with a metal of Group VI and Group VIII of the Periodic Table. The oil soluble salt is used in amounts between 4 and 20 weight percent based on the feed.

A closely related approach is disclosed in U.S. Pat. No. 4,226,742, the entire contents of which are incorporated herein by reference. This patent discloses dissolving an oil soluble metal compound in oil, and converting the compound to a solid, non-colloidal catalyst within the oil and reacting the oil containing the catalyst with hydrogen. Addition of about 10 to about 950 weight ppm of metal or metals as oil soluble compounds is preferred.

U.S. Pat. No. 3,235,508, the entire contents of which are incorporated herein by reference, discloses the advantages obtained by using a colloidal dispersion of catalyst for conversion of heavy crude oils. Examples were given of use of 0.2 to 3.6 weight percent of an impregnated catalyst dispersed in a topped crude. A crude and catalyst mixture, containing 3.6 weight percent catalyst was tested. This catalyst contained 2.0 weight percent cobalt oxide and 4.3 weight percent molybdenum oxide, equivalent to 15 to 20,000 weight part per million cobalt metal and molybdenum metal present in the feed.

In U.S. Pat. No. 4,313,818, the entire contents of which are incorporated herein by reference, a catalyst is made in situ in the reactor by charging oil and a catalyst precursor along with hydrogen, and optionally but preferably with $H_2S$ to a reactor. The oil should have a high Conradson carbon content. In the reducing atmosphere of the reaction zone, the soluble catalyst precursor compounds are reduced and coprecipitated with asphaltic material to produce a high surface area catalyst.

A hydrovisbreaking approach with dispersed catalyst is disclosed in U.S. Pat. No. 4,411,770, the entire contents of which is incorporated herein by reference. The acidic component (ZSM-5 or zeolite beta) and metal component are mixed together and extruded or the metal is added by impregnation. The process upgraded residual fractions, with a limited amount of conversion of the resid to lighter products.

We reviewed the work that others had done with a view towards finding an improved process which would permit the economical upgrading of heavy crude oil fractions or other heavy synthetic fuels.

We learned that it was possible to efficiently and economically upgrade these heavy streams by adding to the stream a metal component, as a thermally decomposable compound, while separately adding an acidic solid catalyst.

SUMMARY OF THE INVENTION

Accordingly the present invention provides a process for hydroconverting a heavy natural or synthetic oil charge stock having a Conradson carbon content in excess of 1 weight percent which comprises: adding to said charge stock a thermally decomposable metal compound in an amount equivalent to about 10 to about 950 weight ppm, calculated as the elemental metal, based on said oil feed, said metal being selected from the group of Groups IVB, VB, VIB, VIIB, and VIII of the Periodic Table of Elements and mixtures thereof; adding to said charge stock an acidic catalyst solid in an amount equal to 0.1 to 10 weight percent of said feed; reacting said oil containing said catalyst and said acidic solid under hydroconversion conditions in a hydroconversion zone to convert at least 25 percent of said Conradson carbon content to lighter materials; recovering a hydroconverted oil as a product of the process.

In another embodiment, the present invention provides a method for upgrading heavy oil stocks containing more than 5 weight percent asphaltenic material, and wherein at least 50 weight percent of said oils boil above 500° C. which comprises contacting said oil with thermally decomposable oil soluble compounds of metals selected from the group VIB and VIII, said metals being present in an amount equal to one to one thousand weight ppm of said oil, and adding to said oil an acidic solid catalyst in an amount equal to 0.1 to 10 weight percent of said oil, at a hydrogen partial pressure of 50 to 250 atmospheres absolute and temperature of 300° to 500° C. for a time sufficient to convert a majority of said asphaltenic materials to non asphaltenes and withdrawing from said reaction zone an oil with reduced asphaltenic content.

DETAILED DESCRIPTION

The present invention provides a hydrocarbon conversion process wherein a heavy feed oil, to which has been added a thermally decomposable metal compound and a separate acidic solid catalyst, is contacted with hydrogen in a high pressure hydroconversion zone. Each of these process parameters will now be discussed.

FEEDSTOCK

Suitable feedstocks for the present invention include both naturally occurring and synthetically prepared feeds. Atmospheric or vacuum residue fractions of crude oil, whole crude oil, oil or bitumen derived from tar sands, and coal derived liquids all may benefit from the practice of the present invention.

A common characteristic of these heavy chargestocks is that they are very difficult to treat by conventional hydrocarbon conversion processes. The high metals content, usually nickel and vanadium, destroys conventional catalyst. The asphaltenic materials contained in these feeds tend to block conventional supports.

At least 75%, and preferably 100% of the feed boils above about 375° C. Typically, the feed will have 5 wt % or more Conradson carbon, preferably 8 to 30 weight % CCT. The feed will usually have more than 1 wt % S, preferably 2 to 5 wt % S.

The feed to be processed may contain other materials, such as diluents or hydrogen donor solvents when desired.

Preferably the feedstocks have been subjected to conventional filtration or desalting to remove any solid materials or salts which may be present in the feed.

THERMALLY DECOMPOSABLE METAL COMPOUND

Suitable thermally decomposable metal compounds include compounds of metals selected from Groups II, III, IV, V, VIB, VIIB, VIII and mixtures thereof of the Periodic Table of Elements. Preferred metal compounds include thermally decomposable compounds of molybdenum, tin, tungsten, vanadium, chromium, cobalt, titanium, iron, nickel and mixtures thereof, e.g., Mo-Fe, Fe-Sn, Ni-Mo, Co-Mo, etc. Preferred compounds of the given metals include the salts of acyclic (straight or branched chain) aliphatic carboxylic acids, salts of alicyclic aliphatic carboxylic acids, heteropoly acids, carbonyls, phenolates and organoamine salts.

The amount of thermally decomposable compound to be added to the feed will be determined by the amount of metal desired in the hydroprocessing zone. It is an advantage of the present invention that operation with only 1 to 250 weight ppm of the desired metal(s) in the hydroprocessing zone gives good results. Part of the reason for the efficient use of metal in the present invention is that the present invention does not rely solely upon the metal added for all catalytic activity within the hydroprocessing zone. It is essential to have an acidic solid catalyst also present in the hydroprocessing zone, as will be discussed in more detail hereafter.

The amount of metal present in the reaction zone must be adjusted too to accommodate the presence of contaminants, especially nickel and vanadium, in the feed. Adjustments must also be made for different operating temperatures and hydrogen partial pressures within the reaction zone, and for the residence time within the reaction zone.

ACID SOLID CATALYST

The use of an acid-acting solid is essential for the practice of the present invention. Any conventional acidic solid catalyst such as $SiO_2/Al_2O_3$, acid exchanged clays, zeolites, etc. can be used. The acidic solid may be continuously added to the feed, in an amount equal to 0.01 to 10 weight percent of the feed. In another embodiment, the acidic solid may be maintained as a fixed, fluidized, ebulated or moving bed within the reaction zone, in which case there need be no addition of acidic solid material to the feedstream, the acid solid will already be present, and remain in, the reaction zone.

Although any acidic solid can be used in the practice of the present invention, it is especially preferred to use relatively large pore zeolites, having openings in excess of 7 Angstrom units. Especially preferred is the use of Y type zeolite, with ultrastable Y giving especially good results. Another very good acidic solid is rare earth exchanged Y zeolite. Usually the Y zeolite is in the sodium form as synthesized, so partial exchange of the sodium for rare earths will yield NaReY.

The relatively large pores of type Y zeolite permit entry of relatively large molecules into the zeolite where the molecules are cracked. Use of intermediate pore size zeolites, such as ZSM-5 zeolite, gives satisfactory results in the present invention, but the relatively small pore size of this zeolite prevents large asphaltenic molecules to enter the zeolite, so that the worst asphaltenic materials are prevented from entering ZSM-5.

Especially preferred acidic solids are high activity acid clays in colloidal form. Amorphous silica-alumina, crystalline aluminosilicates, silico-phospho-aluminates, aluminum phosphates, boro-silicates, galo-silicates, and other materials having acid activity may also be used. Other amorphous and crystalline solids comprised of mixed oxides or sulfides of Al, Ti, Si, and Fe, especially $SiO_2$, $Al_2O_3$, $TiO_2$, $Fe_2O_3$, etc. may be used.

The surface acidity of the amorphous materials may be enhanced by various treatments, including chlorination and fluoridation treatments. Treatment with $AlCl_3$ vapors is a suitable activation procedure.

Any of the above materials may be subjected to ion exchange or other treatment to enhance their acidity or thermal stability. Aluminum exchanged or "pillared" clays are especially suitable for ion exchange treatment.

Regardless of the materials chosen, the materials used as an acidic catalyst for use in the present invention should satisfy two other parameters, pore size or Constraint Index and acid activity, discussed hereafter.

CONSTRAINT INDEX

Typically large pore zeolites are preferred. Ideally, the zeolites for use herein will have a Constraint Index, as hereafter defined, less than 2, and preferably less than 1.

A definition of Constraint Index is provided in U.S. Pat. No. 4,309,279, the entire contents of which is incorporated herein by reference.

Suitably material, so far as a Constraint Index less than 1, include zeolites X, Y, Beta, ZSM-4 and mordenite.

ACID ACTIVITY

The degree of zeolite catalyst activity for all acid catalyzed reactions can be measured and compared by means of "alpha value" (a). The alpha value reflects the relative activity of the catalyst with respect to a high activity silica-alumina cracking catalyst. To determine the alpha value as such term is used herein, n-hexane conversion is determined at a suitable temperature between about 550° F.–1000° F., preferably at 1000° F. Conversion is varied by variation in space velocity such that a conversion level of up to about 60 percent of n-hexane is obtained and converted to a rate constant per unit volume of zeolite and compared with that of silica-alumina catalyst which is normalized to a reference activity of 1000° F. Catalyst activity of the catalysts are expressed as multiple of this standard, i.e., the silica-alumina standard. The silica-alumina reference catalyst contains about 10 percent $Al_2O_3$ and the remainder $SiO_2$. This method of determining alpha, modified as described above, is more fully described in the Journal of Catalysis, Vol. VI, pages 278–287, 1966.

The acid material added must have an acid activity, as defined by the alpha value, of at least 1. Some materials which are suitable for use herein do not have very long-lived acidities at high temperature. For these materials, a meaningful measure of the alpha value can be obtained at low temperatures by measuring conversion of materials such as t-butylacetate.

Ideally, the acidic materials used herein exhibit not only significant acid activity, but are relatively stable at the reaction conditions used. Preferably, the acidic catalyst used herein exhibit a significant amount of stability at the reaction conditions used, i.e., they do not lose activity rapidly. Fortunately, stability is not as crucial a problem in the process of the present invention, as the catalyst can successfully be used in a throwaway-mode, with no recycle of catalyst. Accordingly, many acidic catalyst materials can be used in the practice of the present invention, even they lack sufficient stability to permit their recovery and reuse.

METAL - ACIDIC SOLID ADDITION TO PROCESS

In one preferred embodiment, a small amount of finely divided acidic solid is added to the feed. The feed enters an ebulating or fluidized bed reaction zone which retains catalyst particles larger than a given size, e.g., 50 microns. There is a continual attrition or wearing away, and consequent loss of fluid particles from such an ebulated or fluidized bed, which is continuously replaced with fresh acidic solid added via the feedstream.

Regardless of the method of addition of acidic solid, the active metals are always cofed with the oil, rather than separately impregnated on the catalyst. The advantage of this procedure is that petroleum refiners can, in effect, get finished catalyst for the price of raw materials, without going through a catalyst manufacturing step. Catalyst type can be easily changed while the process is still on stream, i.e., shifting from a predominantly cobalt catalyst to a predominantly molybdenum catalyst, without shutting down the operation and without discarding a non-existent catalyst inventory. In the process of the present invention catalyst is made only as needed, and used immediately after it is made, so there is no catalyst inventory, other than the catalyst inventory that may be present in an ebulating or fluidized bed reaction zone used in one embodiment of the present invention.

REACTION ZONE

The reaction zone conditions are those generally found in conventional hydrotreating and hydrocracking reactors. Hydrogen partial pressures of 10 to 200 atmospheres, absolute may be used, although operation with hydrogen partial pressures of 50 to 150 atmospheres absolute is preferred. Temperatures of 250°–750° C. may be used, and preferably the temperatures are 300°–450° C.

Reactor design is conventional. In its simplest form, the reactor can simply be a length of pipe through which reactants flow. Residence time can be increased by using a bigger or longer piece of pipe or by adjusting the feed rate. It is also possible to operate with an ebulating bed reactor wherein the acidic catalytic solid tends to accumulate within the reactor such that incoming feed sees a fairly large inventory of acidic solid. When operating in this mode liquid hourly space velocities, calculated as volume per hour of liquid feed per volume of catalyst, of 0.1 to 10 may be used.

The present invention is not a substitute for dilute phase catalytic cracking. Because of the heavy materials contained in the feeds to the present invention, the coke production, and heat produced during catalyst regeneration in an FCC unit would be unacceptably high. Another reason for avoiding an FCC riser type cracking is that it is the intent of the present invention to convert asphaltenics to more valuable lighter liquid products, rather than simply produce coke.

Actually, the objectives of the process of the present invention are twofold:

1. To maximize conversion to lower boiling and/or upgraded liquids;
2. Accomplish conversion with minimum loss to coke or asphaltenic byproducts.

Included in the general category of liquid upgrading is demetallation of feed and/or conversion of Conradson carbon residue, CCR in the feed. The use of dispersed metallic hydrogenation functions partially accomplishes this aim. Combination with solid acids improves performance substantially. It is necessary for the practice of the present invention that the dispersed metal and acid both be introduced into the reaction zone.

PRODUCT UPGRADING

Reactor effluent can be subjected to conventional upgrading and treatment. Typically hot reactor effluent would be cooled, and passed through one or more vapor liquid separators. Hydrogen rich vapor can be recycled to the reactor, if desired, to increase the hydrogen to hydrocarbon mole ratio therein. Liquid from the high pressure separator can be subjected to one or more stages of flashing and/or stripping to remove LPG and $H_2S$ produced in the hydrocarbon conversion zone. Any conventional stripper can be used, as long as stripping conditions are sufficient to remove $H_2S$ from the liquid product.

It is within the scope of the present invention to recycle a bottoms fraction or fractions derived from reactor effluent. This bottoms recycle may serve to augment to some extent the addition of acid catalyst solid and metal to the reaction zone, and may also permit increased conversion of heavy materials to lighter products.

EXAMPLE

An Arab Medium vacuum resid (1000° F.+) was processed at 840° F. (449° C.) for 40 minutes under 1600 psig (11,100 kPa) of $H_2$. In one instance the conversion was carried out in the presence of 200 ppm of Mo along; in the second, 8 wt. % of a large pore zeolite, a rare earth exchanged Y, (REY) was also present.

TABLE

| | Run No. | |
|---|---|---|
| | AC364 | AC371 |
| Mo loading | 200 PPM | 200 PPM |
| Acid function | none | 8 wt. % REY |
| PRODUCT WT. % | | |
| $C_4$—gases | 12.33 | 12.08 |
| 1050 F - liquids | 71.65 | 76.00 |
| Asphaltenes | 11.65 | 9.76 |
| Coke | 4.37 | 2.16 |
| H2 consumed scf/bbl | 600 | 600 |
| $VH_2$/Vol Oil | 107 | 107 |

The present invention provides a way to economically upgrade residual fractions. Catalytic hydroconversion is obtained, but most of the costs associated with catalyst manufacturing have been eliminated, because forming, impregnating, pilling, extruding, etc. of catalyst have been eliminated.

Where desired, conventional techniques may be used to recover and recycle either the metal added or the acidic solid added or both.

As is evident, the presence of the acid function increases the yield of usable liquid products while reducing coke yields. The latter effect contributes substantially to the operability of a dispersed or slurry phase process in a continuous mode.

What is claimed is:

1. A process for hydroconverting a heavy natural or synthetic oil charge stock having a Conradson carbon content in excess of 1 weight percent which comprises
   (a) adding to said charge stock a thermally decomposable metal compound in an amount equivalent to about 10 to about 950 weight ppm, calculated as the elemental metal, based on said oil feed, said metal being selected from the group of Groups IVB, VB, VIB, VIIB, and VIII of the Periodic Table of Elements and mixtures thereof;
   (b) adding to said charge stock a separate acidic, zeolite catalyst solid having an alpha value of at least 1 and a Constraint Index less than 1 and no added active metal in an amount equal to 0.1 to 10 weight percent of said feed;
   (c) reacting said oil under hydroconversion conditions in a hydroconversion zone to convert at least 25 percent of said Conradson carbon content to lighter materials;
   (d) recovering a hydroconverted oil as a product of the process.

2. Process of claim 1 wherein said metal is selected from the group of cobalt, molybdenum and mixtures thereof.

3. Process of claim 1 wherein said metal compound is a metal resinate or naphthenate.

4. Process of claim 1 wherein said acidic solid comprises type Y zeolite.

5. Process of claim 4 wherein said type Y zeolite is NaReY zeolite.

6. Process of claim 1 wherein said hydroconversion zone comprises a plug flow reactor.

7. Process of claim 1 wherein said hydroconversion zone comprises a continuous stirred tank reactor.

8. Process of claim 1 wherein said hydroconversion zone comprises an ebulating bed reactor sized in relation to the feed rate to provide a liquid hourly space velocity within said reactor of 0.1 to 10 hours $^{-1}$.

9. Process of claim 1 wherein said feed is an atmospheric or a vacuum residue fraction of a crude oil, said feed contains 5 to 30 weight percent Conradson carbon and 2 to 5 weight percent sulfur and wherein at least 75 weight percent of said feed boils above 375° C.

10. Process of claim 1 wherein said feed comprises bitumen.

11. Process of claim 1 wherein said feed comprises shale oil.

12. A method for upgrading in a reactor heavy oil feed containing more than 5 weight percent asphaltenic material, and wherein all of said feed boils above 375° C. which comprises adding to said feed (i) a thermally decomposable feed soluble compound of at least one metal selected from the group VIB and VIII metals, said metal being present in said reactor in an amount equal to 10 to 950 weight ppm of said feed, and (ii) a separate added zeolite acidic catalyst solid having an alpha value of at least 1 and a Constraint Index less than 1 and no added active metal in an amount equal to 0.1 to 10 weight percent of said oil, and passing the feed with the added thermally decomposable compound and the added acidic catalyst solid to a reactor at a hydrogen partial pressure of 25 to 250 atmospheres absolute and temperature of 250° to 500° C. for a time sufficient to convert a majority of said asphaltenic materials to non asphaltics and withdrawing from said reactor an oil with reduced asphaltenic content, as a product of said process.

13. Process of claim 12 wherein said metal is selected from the group of cobalt, molybdenum and mixtures thereof.

14. Process of claim 12 wherein said metal compound is a metal resinate or naphthenate.

15. Process of claim 12 wherein said acidic solid comprises type Y zeolite.

16. Process of claim 15 wherein said type Y zeolite is NaReY zeolite.

17. Process of claim 12 wherein said reactor comprises a plug flow reactor.

18. Process of claim 12 wherein said reactor comprises a continuous stirred tank reactor.

19. In a process for hydroconverting a heavy natural or synthetic oil charge stock by reacting the oil with hydrogen in the presence of a solid, acidic catalyst after adding to the oil a thermally decomposable metal compound of a metal of Group IVB, VB, VIB, VIIB or VIII of the Periodic Table of Elements, the compound being added in an amount equivalent to 10 to 950 ppm, calculated as the elemental metal, based on the oil feed, the improvement comprising adding a zeolite having an alpha value of at least 1 and a Constraint Index of less than 1 without active metal on the catalyst, to the oil feed having a Conradson carbon content in excess of 1 weight percent, and hydroconverting the oil with the added acidic zeolite catalyst in a hydroconversion zone to convert at least 25 percent of the Conradsen carbon content to lighter materials to form an upgraded oil product.

20. A process according to claim 19 in which the untreated oil has more than 5 weight percent asphaltenic material and boils above 375° C., the majority of the asphaltenic material being converted during the hydroconversion to non-asphaltic material.

* * * * *